US007144260B2

(12) United States Patent
Murayama et al.

(10) Patent No.: US 7,144,260 B2
(45) Date of Patent: Dec. 5, 2006

(54) CONNECTOR

(75) Inventors: Shigeru Murayama, Tokyo (JP); Masanori Kaneko, Tokyo (JP); Shigeru Matsumura, Tokyo (JP); Takashi Sekizuka, Tokyo (JP); Hiroyuki Hama, Tokyo (JP)

(73) Assignee: Advantest Corporation, Tokyo (JP)

( * ) Notice: Subject to any disclaimer, the term of this patent is extended or adjusted under 35 U.S.C. 154(b) by 0 days.

(21) Appl. No.: 11/268,264

(22) Filed: Nov. 4, 2005

(65) Prior Publication Data

US 2006/0057874 A1 Mar. 16, 2006

Related U.S. Application Data

(63) Continuation of application No. 10/971,437, filed on Oct. 22, 2004, which is a continuation of application No. 10/601,069, filed on Jun. 20, 2003, now Pat. No. 6,846,189.

(30) Foreign Application Priority Data

May 28, 2003 (JP) ..... 2003-151536

(51) Int. Cl.
*H01R 4/66* (2006.01)

(52) U.S. Cl. ..... 439/108

(58) Field of Classification Search ..... 439/108, 439/579, 581, 63, 608, 101
See application file for complete search history.

(56) References Cited

U.S. PATENT DOCUMENTS 4,601,527 A * 7/1986 Lemke ..... 439/81
5,022,870 A * 6/1991 Sakamoto et al. ..... 439/608
5,161,987 A * 11/1992 Sinisi ..... 439/101
5,215,477 A * 6/1993 Weber et al. ..... 439/581
5,310,364 A 5/1994 Hooper et al.
5,334,050 A 8/1994 Andrews
6,238,218 B1 5/2001 Baffert
6,354,871 B1 3/2002 Hatakeyama
2005/0277315 A1* 12/2005 Mongold et al. ..... 439/108

FOREIGN PATENT DOCUMENTS

JP 5-45947 6/1993
JP 5-335058 12/1993

(Continued)

OTHER PUBLICATIONS

Korean Office Action issued for Korean Application No. 10-2004-7004805 mailed on Jan. 27, 2006, 2 pages.

(Continued)

*Primary Examiner*—Tulsidas C. Patel
*Assistant Examiner*—Phuongchi Nguyen
(74) *Attorney, Agent, or Firm*—Osha•Liang LLP

(57) ABSTRACT

A connector mounted on a board having a plurality of board signal lines for transmitting a signal and a board ground line grounded. Each of the plurality of board signal lines includes a plurality of signal terminals formed in correspondence to each of the signal lines. Each of the signal terminals comprises: a signal core line formed of conductor by extension in the shape of a line; a shield for core line formed of conductor insulated from the signal core line electrically so as to extend in an axis direction of the signal core line and enclose the signal core line; a signal electrode formed by extension from the signal core line for connecting the signal core line with the board signal line corresponding to the signal terminal; and a plurality of ground electrodes extended from the shield for core line and opposed to each other by intervention of the signal electrode for connecting the shield for core line with the board ground line respectively.

12 Claims, 12 Drawing Sheets

FOREIGN PATENT DOCUMENTS

| | | |
|---|---|---|
| JP | 7-73931 | 3/1995 |
| JP | 2522039 | 10/1996 |
| JP | 2001-28285 | 1/2001 |
| KR | 2001-62150 | 7/2001 |
| WO | WO-98/33243 | 7/1998 |

OTHER PUBLICATIONS

German Office Action issued for German Application No. 103 92 964.9-34 dated Feb. 16, 2006, 4 pages.

Patent Abstracts of Japan, Publication No.: 04-006775, Publication Date: Jan. 10, 1992, 1 page.

Patent Abstracts of Japan, Publication No.: 05-335058, Publication Date: Dec. 17, 1993, 2 pages.

Patent Abstracts of Japan, Publication No.: 07-073931, Publication Date: Mar. 17, 1995, 2 pages.

Patent Abstracts of Japan, Publication No.: 2001-028285, Publication Date: Jan. 30, 2001, 2 pages.

Japanese Office Action issued for Japanese Application No. 2003-151536 mailed on Apr. 11, 2006, and English translation thereof, 8 pages.

* cited by examiner

CONNECTOR

CROSS-REFERENCE TO RELATED APPLICATIONS

This application is a continuation of U.S. patent application Ser. No. 10/971,437, entitled "Connector" and filed on Oct. 22, 2004, which is a continuation of U.S. patent application Ser. No. 10/601,069, entitled "Connector" and filed on Jun. 20, 2003 now U.S. Pat. No. 6,846,189.

BACKGROUND OF THE INVENTION

The present application claims priority from a Japanese Patent Application No. 2003-151536 filed on May 28, 2003, the contents of which is incorporated herein by reference.

1. Field of the Invention

The present invention relates to a connector holding a plurality of signal terminals and ground terminals.

2. Description of the Related Art

When an electronic device under test is tested in semiconductor testing apparatus etc., a signal is exchanged, for example by way of test heads that intervene between tester control units generating the signal which is necessary for a test and the electronic device.

With high performance of an electronic device of recent years, a test of an electronic device has been advanced. For this reason, in a transmission line relaying a signal, deterioration of a signal or mixture of a noise from circumferences may impede a test of the electronic device.

SUMMARY OF THE INVENTION

Therefore, it is an object of the present invention to provide a connector that can solve the foregoing problems. The above and other objects can be achieved by combinations described in the independent claims. The dependent claims define further advantageous and exemplary combinations of the present invention.

According to the first aspect of the present invention, there is provided a connector mounted on a board having a plurality of board signal lines for transmitting a signal and a board ground line grounded. Each of the plurality of board signal lines includes a plurality of signal terminals formed in correspondence to each of the signal lines, and each of the signal terminals comprises: a signal core line formed of conductor by extension in the shape of a line; a shield for core line formed of conductor insulated from the signal core line electrically so as to extend in an axis direction of the signal core line and enclose the signal core line; a signal electrode formed by extension from the signal core line for connecting the signal core line with the board signal line corresponding to the signal terminal; and a plurality of ground electrodes extended from the shield for core line and opposed to each other by intervention of the signal electrode for connecting the shield for core line with the board ground line respectively.

The connector may further comprise a housing holding a part of each of the plurality of signal terminals by two lines side by side in which a first row and a second row are parallel to each other. The connector is mounted to one side of the board on which its front face is parallel to the axis direction, the signal electrode of the signal terminal in the first row is faced by intervention of the signal electrode of the signal terminal in the second row and the board, the signal electrode of the signal terminal in the first row is connected with the board signal line formed on the front face of the board, the signal electrode of the signal terminal in the second row is connected with the board signal line formed on a rear face of the board.

The connector may further comprise a housing holding at least a part of the plurality of signal terminals in the predetermined arrangement orientation side by side. A side surface parallel to the axis direction and the arrangement orientation in the housing is formed in the shape of a wave protruded in the direction perpendicular to said side surface respectively in each position holding the plurality of signal terminals.

In the connector, the housing holds the plurality of signal terminals by two lines side by side, by zigzag arrangements of a first row and a second row disposed parallel to each other, in the housing, the side surface close to the first row is formed in the shape of a wave protruded in the direction perpendicular to said side surface respectively in each position holding the plurality of signal terminals in the first row, the side surface parallel to the second row is formed in the shape of a wave protruded in the direction perpendicular to said side surface respectively in each position holding the plurality of signal terminals in the second row.

In the connector, apart of vicinity of an end close to the ground electrode in the shield for core line is formed so as to enclose the signal core line by generally semicircle, the signal electrode is formed by extension in the direction apart from the shield for core line and generally perpendicular to the axis direction.

In the connector, the plurality of signal terminals are disposed by arrangement orientation side by side to which the extension direction of each of the signal electrodes directs.

The connector may further comprise: a housing holding the plurality of signal terminals; and rivets fixing the housing to the board.

In the connector, the connector is connected to other connectors opposed to the board by intervention of the connector, the housing has housing through-holes formed by penetrating it from a face supposed to the connector to its rear face, the board has board through-holes formed by penetrating it from a face supposed to the housing to its rear face in correspondence to the housing through-holes, the rivets are inserted into the housing through-holes and the board through-holes in the direction from the housing to the board, so that one end opposed to the other connector is accommodated to the housing through-holes and another end is protruded from the rear face of the board.

The connect or may further comprise a housing holding a part of each of the plurality of signal terminals by zigzag arrangement of two lines consisted of a first row and a second row parallel to each other; and two positioning members prescribe a position of other connectors connected to the connector by forming to protrude from the surface of the housing in a position forming zigzag arrangements with the terminals, so that the members are adjacent to the signal terminals respectively disposed on one end of each of the first row and the second row and are faced each other by intervention of the plurality of signal terminals.

In the connector, the housing holds the signal terminals of the same number respectively in the first row and the second row.

In the connector, the connector is connected to other connectors having a connected core line connected with the signal core line, the signal core line is connected by engaging it to the connected core line in its end, the shield for core line includes a circle-shaped extension part protruding from an inside surrounding the signal core line to the signal core line by extension in the shape of a circle surrounding the signal core line in the vicinity of one end of the signal core line.

In the connector, the signal terminals are engaged with each of the signal core line and the shield for core line and are connected to a connected terminal having a connected core line and a connected shield, one side of the signal core line and the connected core line is a core line terminal of male type, another side is a core line terminal of female type pressing that outer face by an elastic force in inner face contacted with outer face of the core line terminal of male type, one side of the shield for core line and the connected shield is a shield terminal of male type, another side is a shield terminal of female type pressing that outer face by an elastic force in inner face contacted with outer face of the shield terminal of male type, when the signal terminal and the connected terminal are connected, one side of the signal core line and the shield for core line is contactedwiththe connected core line or the shield for core line prior to contaction with another side.

In the connector, when the signal terminal and the connected terminal are connected, the shield for core line is contacted with the connected shield before the signal core line is connected to the connected core line.

In the connector, until a tip of the shield terminal of male type is inserted into a predetermined position in inside of the shield terminal of female type, the shield terminal of female type presses outside of the shield terminal of male type with an elastic force to increase gradually according to advance of the tip to inside of the shield terminal of female type, after the tip of the shield terminal of male type is inserted into the predetermined position, the signal core line is connected to the connected core line.

According to the second aspect of the present invention, there is provided a connector including a plurality of signal terminals for transmitting a signal and a housing for holding the plurality of signal terminals. The signal terminals comprises: a signal core line formed of conductor by extension in the shape of a line; a first shield formed of conductor insulated from the signal core line electrically and accommodated in the housing so that the first shield encloses the signal core line by the extension from the vicinity of the tip of the signal core line to an axis direction of the signal core line; a protrusion part protruded in a direction depart from the signal core line and formed by the extension from the termination end of the first shield to be locked in the surface of the housing; and a second shield formed of conductor insulated from the signal core line electrically so that the tip intervenes between the signal core line and the first shield in the vicinity of the protrusion part and the second shield encloses the signal core line by the extension from the tip to an axis direction.

According to the third aspect of the present invention, there is provided a connector including a signal terminals for transmitting a signal. The signal terminal comprises: a signal core line formed of conductor by extension in the shape of a line; a shield for core line formed of conductor insulated from the signal core line electrically so that a part in the vicinity of one end of the shield encloses the signal core line by semicircle by extension in an axis direction of the signal core line; a signal electrode formed by extension from an end of the signal core line generally vertically to the axis direction, in the direction depart from the shield for core line, and nearly to another end of the shield for core line; and a ground electrode formed by extension from another end of the shield for core line generally parallel to the signal electrode.

According to the fourth aspect of the present invention, there is provided a connector mounted on a board, comprising: a signal terminal for transmitting a signal; a housing for holding the signal terminal; and a rivet for fixing the housing to the board.

According to the fifth aspect of the present invention, there is provided a connector including a signal terminal for transmitting a signal. The signal terminal comprises: a signal core line formed of conductor by extension in the shape of a line and connected to a connected core line of other connectors that is connected to the connector by engaging their ends; and a shield for core line formed of conductor insulated from the signal core line electrically for including a circle-shaped extension part protruding from an inside surrounding the signal core line to the signal core line by extension in the shape of a circle surrounding the signal core line in the vicinity of one end of the signal core line.

According to the sixth aspect of the present invention, there is provided a connector including a signal terminal that is connected to a connected terminal with a connected core line and a connected shield, the signal terminal comprising: a signal core line formed of conductor by extension in the shape of a line for engaging with the connected core line; and a shield for core line formed of conductor insulated from the signal core line electrically so as to enclose the signal core line by extension in an axis direction of the signal core line for engaging with the connected shield, wherein one side of the signal core line and the connected core line is a core line terminal of male type, another side is a core line terminal of female type pressing that outer face by an elastic force in inner face contacted with outer face of the core line terminal of male type, one side of the shield for core line and the connected shield is a shield terminal of male type, another side is a shield terminal of female type pressing that outer face by an elastic force in inner face contacted with outer face of the shield terminal of male type, when the signal terminal and the connected terminal are connected, one side of the signal core line and the shield for core line is contacted with the connected core line or the shield for core line prior to contaction with another side.

The summary of the invention does not necessarily describe all necessary features of the present invention. The present invention may also be a sub-combination of the features described above. The above and other features and advantages of the present invention will become more apparent from the following description of the embodiments taken in conjunction with the accompanying drawings.

DETAILED DESCRIPTION OF THE INVENTION

The invention will now be described based on the preferred embodiments, which do not intend to limit the scope of the present invention, but exemplify the invention. All of the features and the combinations thereof described in the embodiments are not necessarily essential to the invention.

Figure 1A:
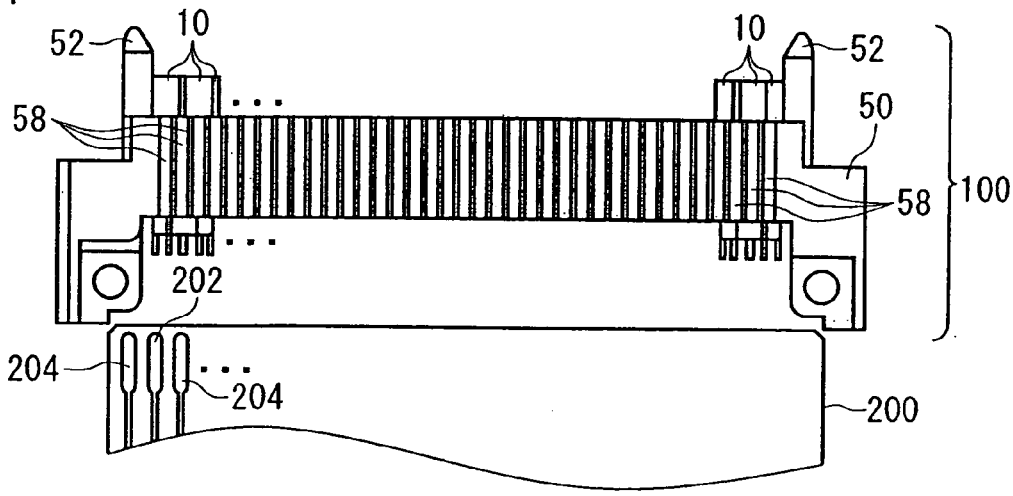
FIG. 1A shows a plug connector seen from a direction perpendicular to a surface of a plug-side board.
Figure 1B:
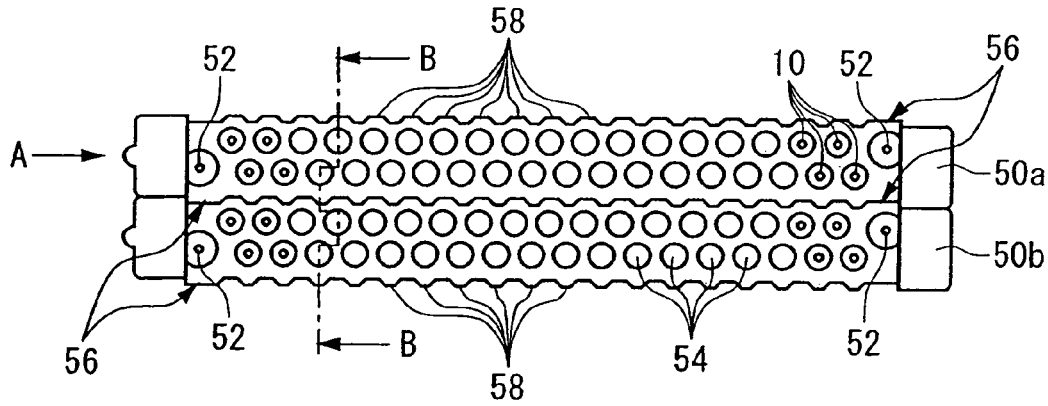
FIG. 1B shows a plug-side housing seen from a direction perpendicular to a connector contact surface that is a contact surface with a receptacle-side connector.
Figure 1C:
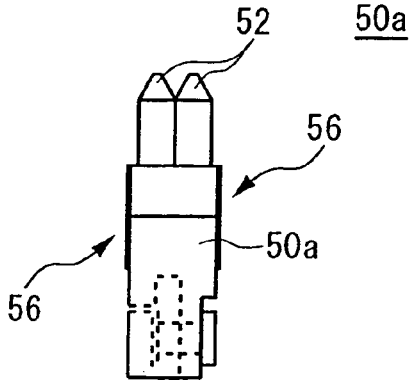
FIG. 1C shows the plug-side housing seen from the direction A.

FIGS. 1A, 1B and 1C show configurations of a plug connector 100 according to an example of the embodiment. One end of the plug connector 100 is connected to a receptacle-side connector and another end is mounted on one side of a plug-side board 200. By this, the plug connector 100 relays an electric signal between the receptacle-side connector and the plug-side board 200. The plug-side board 200 has a plurality of board signal lines 202 to transmit signals and board ground lines 204, which are grounded. The plug connector 100 comprises a plug-side housing 50 and a plurality of plug signal terminals 10.

FIG. 1A shows a plug connector 100 seen from a direction perpendicular to a front surface of the plug-sideboard 200. FIG. 1B shows a plug-side housing 50 seen from a direction perpendicular to a connector contact surface that is a contact surface with a receptacle-side connector. A plug-side housing 50*a* and a plug-side housing 50*b* are stacked in FIG. 1B. FIG. 1C shows the plug-side housing 50*a* seen from the direction A.

A rectangular face formed substantially parallel to a connector contact surface is defined as a top face. Then, the plug-side housing 50 is formed by the extension from the top face in a direction generally perpendicular to the top face and shorter than the length of the plug signal terminal 10. The plug-side housing 50 includes a plurality of through-holes 54, two positioning members 52, two side surfaces 56, and a plurality of convex parts 58.

The through-holes 54 are formed in the shape of a cylinder by penetrating the plug-side housing 50 in a generally vertical direction from its top face to its back face. Each of the plurality of plug signal terminals 10 is inserted into each of the through-holes 54. By this, the plug-side housing 50 holds the plurality of plug signal terminals 10.

In addition, the plurality of through-holes 54 are serially disposed on the top face of the plug-side housing 50 in a predetermined arrangement orientation at regular. These through-holes 54 form a first row and a second row, which are two lines parallel to each other. By this, the plug-side housing 50 holds at least some of each of the plurality of signal terminals by putting them side by side with the first row and the second row parallel to each other.

Furthermore, the through-holes 54 form zigzag arrangements in which the center of one through-hole 54 in the second row is disposed on a generally vertical bisection line of line segment joining each center of two adjacent through-holes 54 formed on the first row. By this, the plug-side housing 50 holds the plurality of plug signal terminals 10, by zigzag arrangements of the first row and the second row disposed parallel to each other. In addition, the plug-side housing 50 in FIG. 1 holds the plurality of plug signal terminals 10 respectively at both ends of each of the first row and the second row.

In the plug-side housing 50, the two side surfaces 56 are formed parallel to an axis direction and an arrangement orientation of the plug signal terminals 10 respectively. The side surface 56 includes a plurality of convex parts 58. The convex parts 58 are formed by projecting in a direction perpendicular to the side surfaces 56 to enclose the plug signal terminal 10 and extending in an axis direction of the plug signal terminals 10, in each position of the plurality of the plug signal terminals 10. By this, the concavo-convex side surfaces 56 are formed. Concave parts formed between the adjacent convex parts 58 accommodate projections of the convex parts 58 formed by the other plug-side housing 50. Additionally, the convex parts 58 and the concave parts may be formed into a trapezoidal, a rectangular, or a curved surface shape.

Furthermore, the plug-side housing 50 in the present embodiment holds the first row and the second row having the same number of the signal terminals 10 respectively. By this, the two plug-side housings 50 can be stacked adequately by engaging corrugated surfaces of the side surfaces 56.

The two positioning members 52 are adjacent to the plug signal terminals 10 respectively disposed on each end of the first row and the second row. The two positioning members 52 are arranged in a position where the members and the plug signal terminals form zigzag arrangements so that the members are faced each other by intervention of the terminals 10, by projecting from the surface of the plug-side housings 50 in an axis direction of the plug signal terminals 10. By this, a position of the receptacle-side connector connected with the plug connector 100 is determined.

In addition, because the two positioning members 52 are disposed opposite each other at both ends of two lines with zigzag arrangements, the two positioning members 52 are arranged substantially symmetrically to the center of the top face. By this, the two positioning members 52 can stably connect the plug connector 100 with the receptacle-side connector. Alternatively, the plug-side housing 50 includes two or more positioning members.

Figure 2:
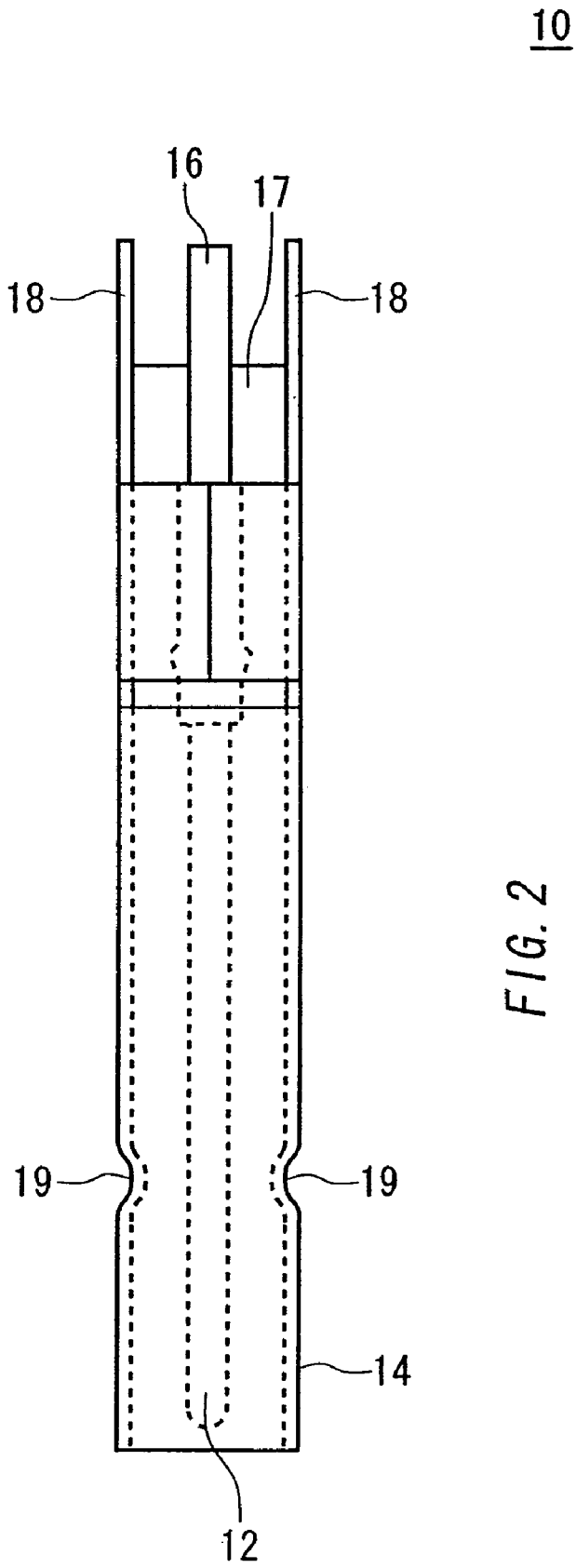
FIG. 2 shows an example of a detailed configuration of a plug signal terminal.

FIG. 2 shows an example of a detailed configuration of the plug signal terminal 10. The plug signal terminal 10 includes a plug signal core line 12, a shield for plug core lines 14, an insulation member 17, a plug signal electrode 16, two plug ground electrodes 18, and a circle-shaped extension part 19.

The plug signal core line 12 is formed in the shape of a line by extending a conductor such as metal. The shield for plug core lines 14 is formed in the shape of a cylinder with the generally identical diameter as the inside diameter of the through-hole 54 (see FIG. 1). The shield for plug core lines 14 is formed longer than the plug signal core line 12 so that a conductor insulated from the plug signal core line 12 encloses the core line by the extension in an axis direction of the core line 12.

The insulation member 17 is an insulator such as, for example, resin, and is filled in a gap between the shield for plug core lines 14 and the plug signal core line 12. By this, the shield forplug core lines 14 is electrically insulated from the plug signal core line 12.

The plug signal electrode 16 is formed by the generally parallel extension in an axis direction from the plug signal core line 12. In addition, the two plug ground electrodes 18 is formed by extending in an axis direction from the shield for plug core lines 14 and facing each other by intervention of the plug signal electrode 16.

The circle-shaped extension part 19 is formed by extending the core line 12 in the shape of a circle enclosing the core line and protruding the extension from an inner surface enclosing the core line to the core line 12, in the part of a surface of the shield for plug core lines 14 and in the vicinity of one end of the plug signal core line 12.

Figure 3A:
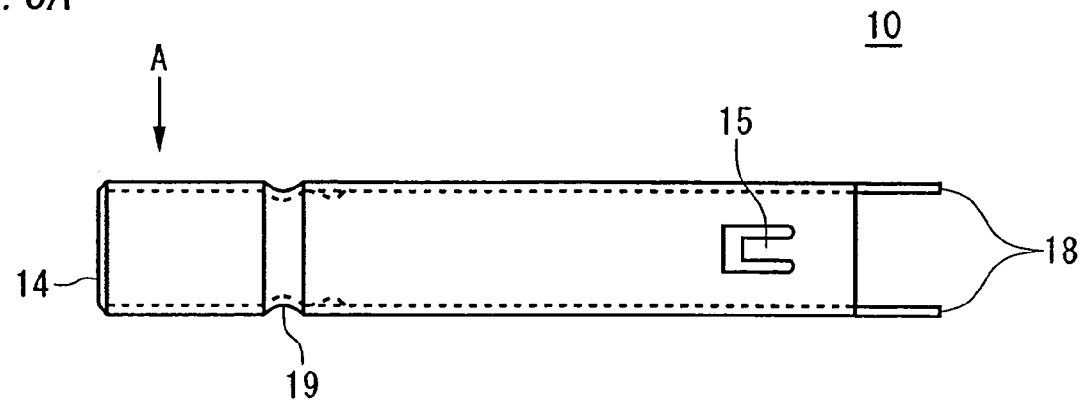
FIG. 3A shows a shield for plug core lines and a plug ground electrode seen from a direction that faced the surface of the plug-side board.
Figure 3B:
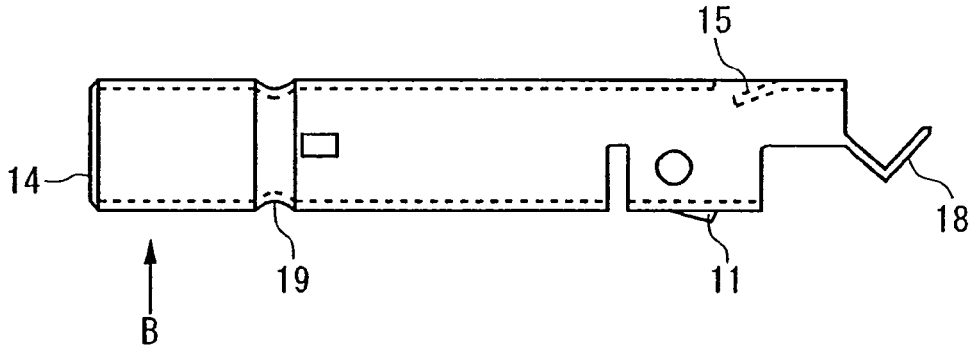
FIG. 3B shows the shield for plug core lines and the plug ground electrode seen from the direction A.
Figure 3C:
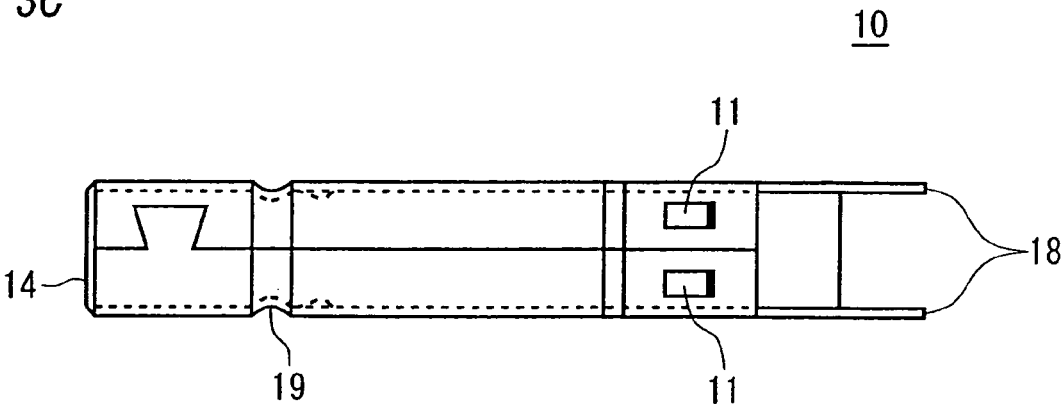
FIG. 3C shows the shield for plug core lines and the plug ground electrode seen from the direction B.

FIGS. 3A, 3B and 3C show examples of a detailed configuration of the shield for plug core lines 14 and the plug ground electrode 18. FIG. 3A shows the shield for plug core lines 14 and the plug ground electrode 18 seen from a direction that faced the surface of the plug-side board 200 (see FIG. 1). FIG. 3B shows the shield for plug core lines 14 and the plug ground electrode 18 seen from the direction A. FIG. 3C shows the shield for plug core lines 14 and the plug ground electrode 18 seen from the direction B. The shield for plug core lines 14 includes a projection 11 and a stop 15.

The projection 11 is formed by protrusion from the surface of the shield for plug core lines 14 to the outside of the surface. The projection 11 locks the plug signal terminal 10 as against the plug-side housing 50, in an inside face of the through-hole 54 (see FIG. 1) into which the plug signal terminal 10 (see FIG. 2) is inserted.

The stop 15 is formed by extension from the surface of the shield for plug core lines 14 to the inside of the surface for holding the insulation member 17 (see FIG. 2). By this, the insulation member 17 fixes the plug signal core line 12 (see FIG. 2). As described above, in the present embodiment, the plurality of plug signal terminals 10 can be surely fixed to the plug-side housing 50 in the state that the shield for plug core lines 14 has been insulated.

Figure 4A:
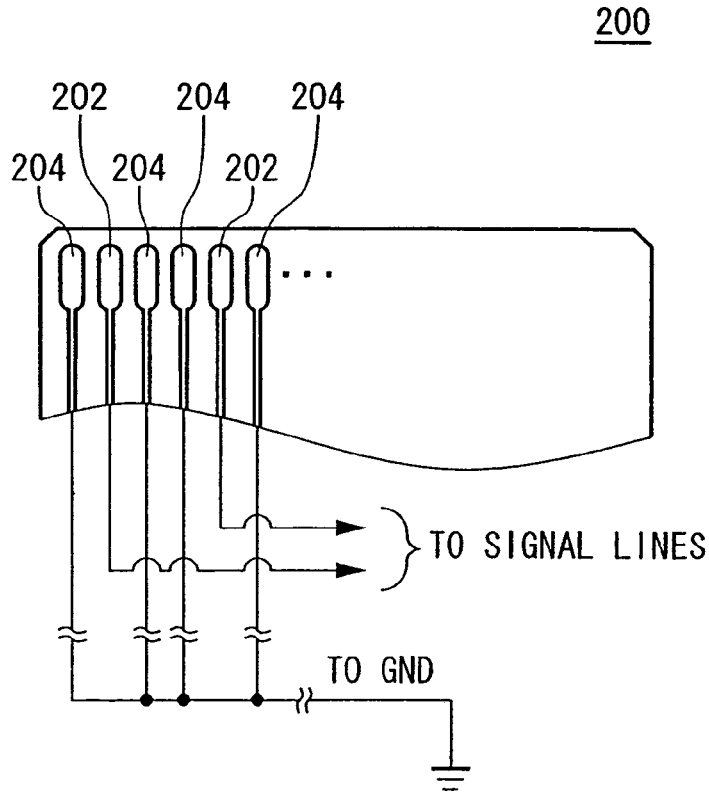
FIG. 4A shows the surface of the plug-side board.
Figure 4B:
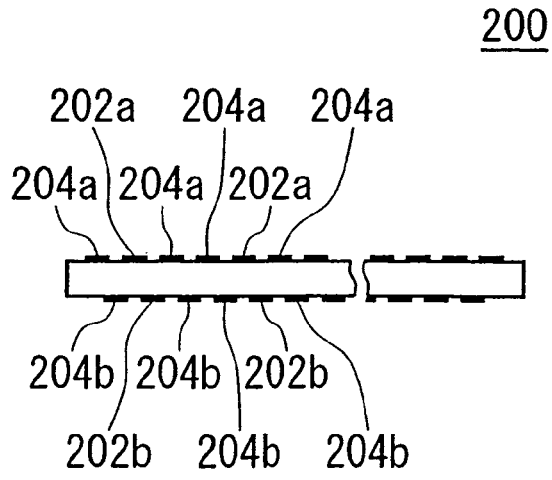
FIG. 4B shows the plug-side board seen from a direction perpendicular to the connector contact surface.

FIGS. 4A and 4B show examples of a detailed configuration of the plug-side board 200. FIG. 4A shows the surface of the plug-side board 200. FIG. 4B shows the plug-side board 200 seen from a direction perpendicular to the connector contact surface.

The plug-side board 200 is, for example, agenerally rectangular board generally parallel to an axis direction of the plug signal terminal 10. The plug-side board 200 has a plurality of board signal lines 202*a* and a plurality of board ground lines 204*a* in its front face, and has a plurality of board signal lines 202*b* and a plurality of board ground lines 204*b* in its rear face. Each board signal line 202 is independently provided to each other electrically, and each board ground line 204 is grounded.

Each of board signal lines 202*a* and board signal lines 202*b* is disposed with zigzag arrangements formed by the plurality of plug signal terminals 10. By this, the plug-side board 200 is connected with the plurality of plug signal terminals 10 adequately.

Figure 5:
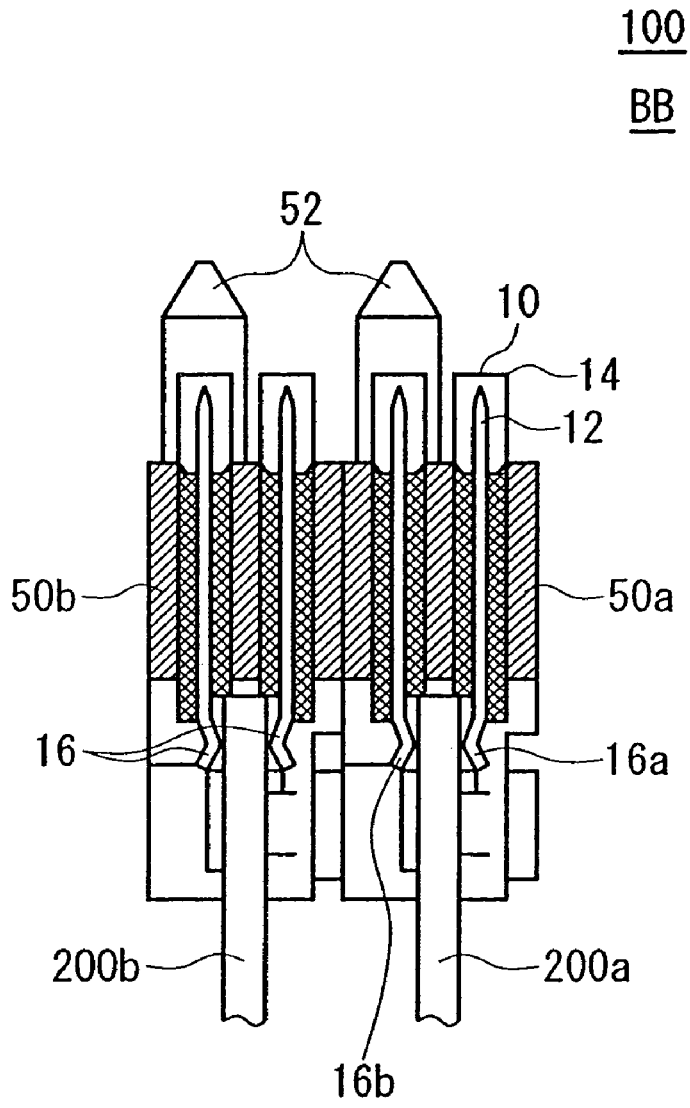
FIG. 5 shows a sectional view taken on line B—B of the plug connector depicted in FIG. 1B.

FIG. 5 shows a sectional view taken on line B—B of the plug connector depicted in FIG. 1B. A plug signal electrode 16*a* of the plug signal terminal 10 in the first row and a plug signal electrode 16*b* of the plug signal terminal 10 in the second row are faced each other by intervention of the plug-side board 200*a*. By this, the plug signal electrodes 16*a* of eachplug signal terminal 10 in the first row are contacted with each of the board signal lines 202*a* (see FIG. 4B) formed on the front face of the plug-side board 200*a*, and the plug signal electrodes 16*b* of each plug signal terminal 10 in the second row are contacted with each of the board signal lines 202*b* (see FIG. 4B) formed on the rear face of the plug-side board 200*a*. Likewise, the plug ground electrodes 18 (see FIG. 2) in the first row are contacted with the board ground lines 204*a* (see FIG. 4B) formed on the front face of the board, and the ground electrodes 18 (see FIG. 2) in the second row are contacted with the board ground lines 204*b* (see FIG. 4B) formed on the rear face of the board.

As described above, the plurality of plug signal terminals 10 correspond to the plurality of board signal lines 202 respectively. The plug signal electrode 16 connects electrically the plug signal core line 12 to the board signal lines 202 corresponding to the plug signal terminal 10, and the plug ground electrode 18 connects electrically the shield for plug core lines 14 to the board ground line 204. By this, the signal received by the plug signal core line 12 can be transmitted to the plug-side board 200.

Figure 6A:
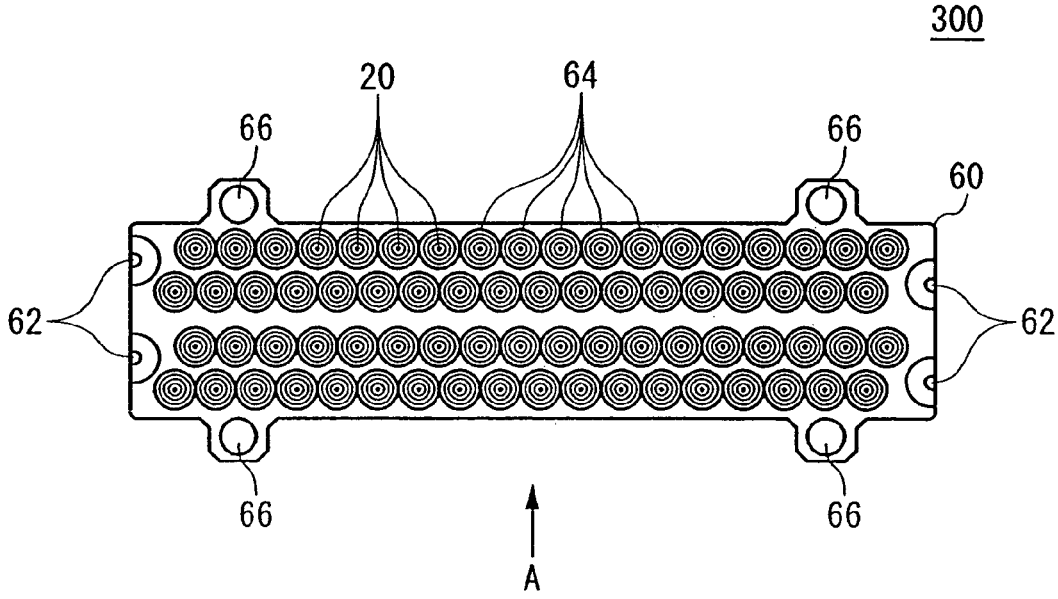
FIG. 6A shows a receptacle connector seen from a direction perpendicular to the connector contact surface.
Figure 6B:
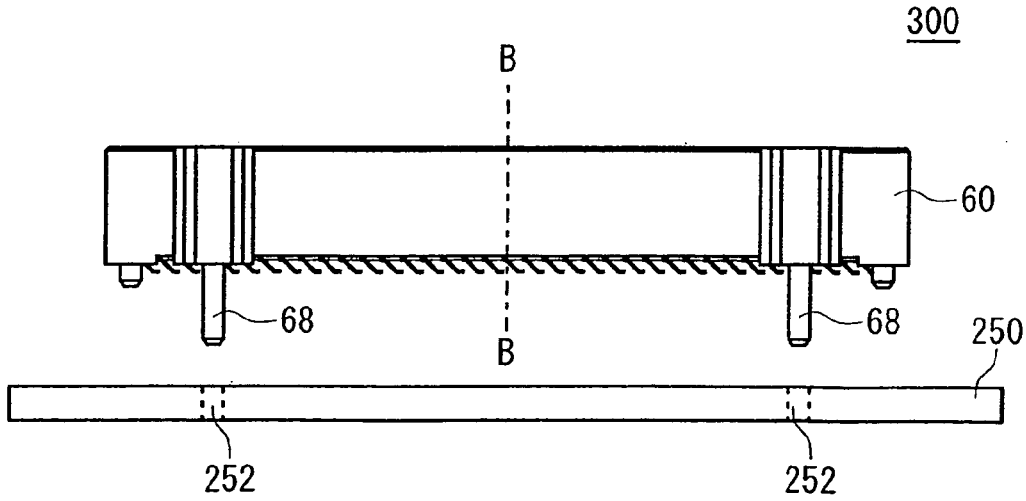
FIG. 6B shows the receptacle connector seen from the direction A.

FIGS. 6A and 6B show configurations of a receptacle connector 300 according to another example of the present embodiment. The receptacle connector 300 is an example of a connector of receptacle side connected with, for example, the plug connector 100 (see FIG. 1). FIG. 6 A shows the receptacle connector 300 seen from a direction perpendicular to the connector contact surface. FIG. 6B shows the receptacle connector 300 seen from the direction A.

The receptacle connector 300 is a connector mounted on the receptacle-side board 250. The receptacle connector 300 is connected with the plug connector 100 (see FIG. 1) opposed to the receptacle-side board 250. The receptacle connector 300 includes a receptacle-side housing 60 and a plurality of receptacle signal terminals 20.

The generally identical face as the top face of the two plug-side housing 50, which is stacked, is defined as a top face. Then, the receptacle-side housing 60 is formed by the extension from the top face in a direction generally perpendicular to the top face and the generally identical length as the length of the receptacle signal terminals 20. The receptacle-side housing 60 includes four positioning bores 62, a plurality of accommodation parts 64, four housing through-holes 66, and rivets 68.

The positioning bores 62 are formed by penetrating the receptacle-side housing 60 from its top face to its back face, in correspondence to the four positioning members 52 (see FIG. 1) formed in the plug connector 100. Each of the four positioning bores 62 is engaged with each of the four positioning members 52. By this, the positioning members 52 and the positioning bores 62 can justly prescribe a position of the receptacle-side housing 60 as against the plug-side housing 50.

Each of the plurality of accommodation parts 64 accommodates the receptacle signal terminals 20 respectively.

Furthermore, each of the plurality of accommodation parts 64 accommodates a part of each of the plug signal core line 12 (see FIG. 2) and the shield for plug core lines 14 (see FIG. 2). By this, the receptacle-side housing 60 holds the plurality of receptacle signal terminals 20. In thepresent embodiment, each of the plurality of accommodation parts 64 holds the plurality of receptacle signal terminals 20 by zigzag arrangements of four lines, in a position opposed to each of the plurality of plug signal terminals 10 (see FIG. 1) held in the plug-side housing 50.

The four housing through-holes 66 are formed in the shape of a cylinder by penetration from the top face of the receptacle-side housing 60 to its back face. In addition, the four housing through-holes 66 intervene the four lines of zigzag arrangements in the receptacle-side housing 60 and are opposed to each other by two holes.

The rivets 68 are formed by, for example, steel or aluminum in the shape of a cylinder having the same diameter as inside diameter of the housing through-holes 66. The rivets 68 are inserted into the housing through-holes 66 and board through-holes 252 provided in the receptacle-side board 250 in the direction from the receptacle-side housing 60 to the receptacle-side board 250, so that one end opposed to the plug connector 100 is accommodated to the housing through-holes 66 and another end is protruded from the rear face of the receptacle-side board 250.

Here, the board through-holes 252 are provided by penetration from the front face of the receptacle-side housing 60 to its rear face, in correspondence to the housing through-holes 66 in the receptacle-side board 250.

When the rivet is to be swaged, one end of the rivet 68 opposed to the plug connector 100 is disposed in a position that is not protruded from the top face of the receptacle-side housing 60, and another end of the rivet 68 protruded from the back face of the receptacle-side board 250 is squashed by, for example, a rivet hit. By this, the rivets 68 fix the receptacle-side housing 60 to the receptacle-side board 250 without interfering with one end of the opposite plug connectors 100 and the rivets 68.

Figure 7A:
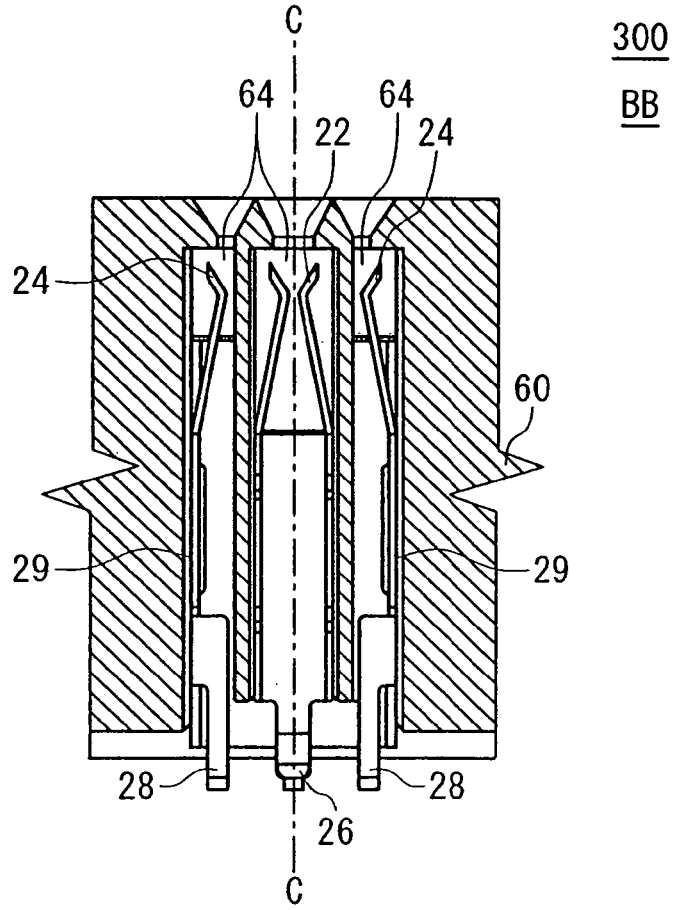
FIG. 7A shows a sectional view taken on line B—B of a receptacle signal terminal in FIG. 6B.
Figure 7B:
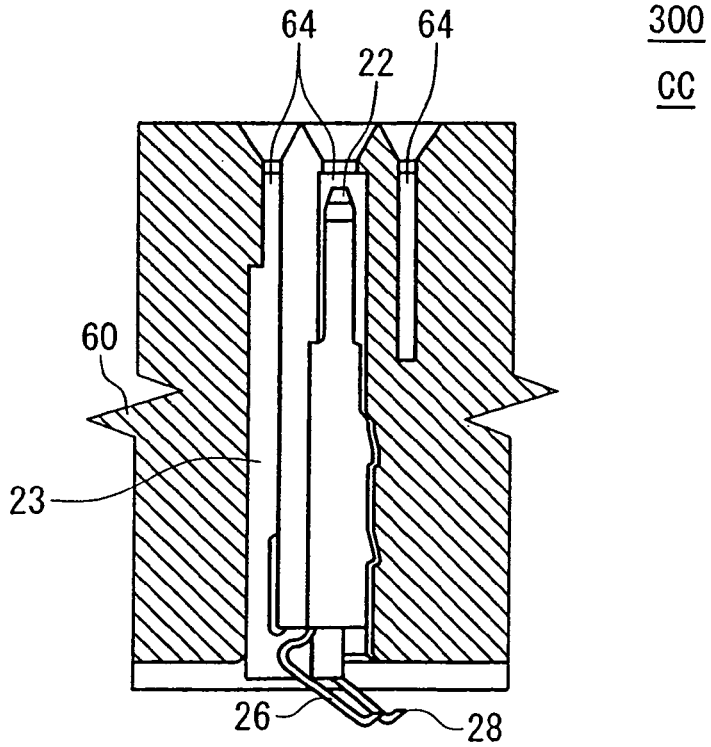
FIG. 7B shows a sectional view taken on line C—C of FIG. 7A.

FIGS. 7A and 7B show examples of a detailed configuration of the receptacle connector 300. FIG. 7A shows a sectional view taken on line B—B of the receptacle signal terminal 20 in FIG. 6B. FIG. 7B shows a sectional view taken on line C—C of FIG. 7A. The receptacle signal terminal 20 includes a receptacle signal core line 22, a shield for receptacle core lines 24, a receptacle signal electrode 26, a semicircle part 23, a receptacle ground electrode 28, and a semicircle-shaped extension part 29. The receptacle signal electrode 26 and the receptacle ground electrode 28 are connected with the board signal line and the board ground line which may be included on, for example, the front face of the receptacle-side board 250 (see FIG. 6B).

In addition, the receptacle signal core line 22, the shield for receptacle core lines 24 and the semicircle-shaped extension part 29 may have the same functions as the functions of the plug signal core line 12 and the shield for plug core lines 14 in the plug signal terminal 10 described in FIG. 2.

The semicircle part 23 is a shield formed in the shape of a semicircle in the shield for receptacle core lines 24. Additionally, the semicircle-shaped extension part 29 has the same functions as the functions of the circle-shaped extension part 19 except that the semicircle part 23 is formed in the shape of a semicircle, while the circle-shaped extension part 19 is formed in the shape of a circle.

Figure 8A:
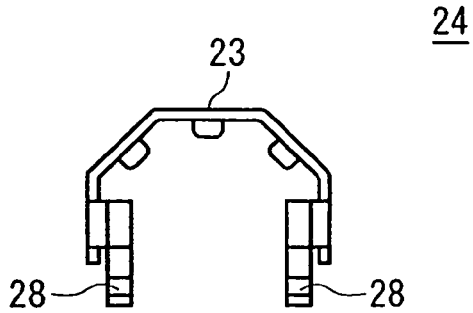
FIG. 8A shows a shield for receptacle core lines seen from a direction generally perpendicular to the connector contact surface.
Figure 8B:
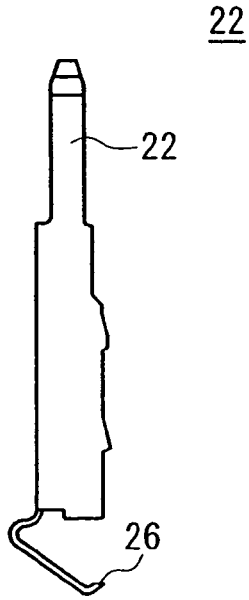
FIG. 8B shows a receptacle signal core line seen from a direction perpendicular to the sectional view taken on line C—C of FIG. 7A.
Figure 8C:
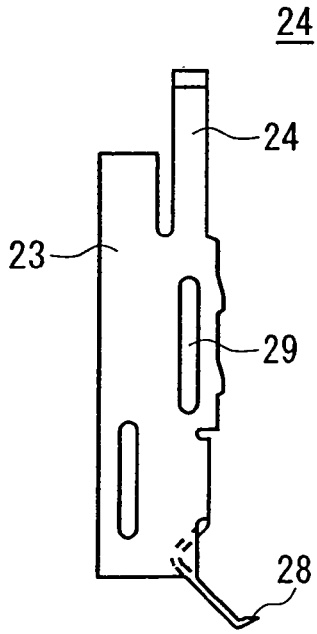
FIG. 8C shows the shield for receptacle core lines seen from the same direction.

FIGS. 8A, 8B and 8C show examples of a detailed configuration of the receptacle signal core line 22 and the shield for receptacle core lines 24. FIG. 8A shows the shield for receptacle core lines 24 seen from a direction generally perpendicular to the connector contact surface. FIG. 8B shows the receptacle signal core line 22 seen from a direction perpendicular to the sectional view taken on line C—C of FIG. 7A. FIG. 8C shows the shield for receptacle core lines 24 seen from the same direction.

The semicircle part 23 is formed in the vicinity of an end near to the receptacle ground electrode 28 in the shield for receptacle core lines 24 so as to enclose the receptacle signal core line 22 by nearly semicircle.

The receptacle signal electrode 26 is formed by the extension from the receptacle signal core line 22 in a direction generally perpendicular to an axis direction of the receptacle signal terminal 20 (see FIG. 6) and in a direction apart from the shield for receptacle core lines 24.

The two receptacle ground electrodes 28 are formed by the extension from the shield for receptacle core lines 24 in the half-moon direction that is the direction that faces from an arc of the semicircle part 23 to its string. Moreover, the two receptacle ground electrodes 28 are formed generally parallel to the extension direction of the receptacle signal electrode 26 and opposite to each other by the intervention of the receptacle signal electrode 26.

In addition, the receptacle signal core line 22 in accommodation part 64 (see FIG. 7) is inserted into the inside of the shield for receptacle core lines 24. The receptacle signal core line 22 and the shield for receptacle core lines 24 are electrically insulated by an insulator such as resin with which the inside of the shield for receptacle core lines 24 is filled.

The receptacle-side housing 60 is formed from for example resin. Additionally, the shield for receptacle core lines 24 is formed in the shape of a semicircle lacked partly. By this, an inside insulator of the shield for receptacle core lines 24 and resin of the receptacle-side housing 60 surrounding the outside of the shield for receptacle core lines 24 are formed in an integrated form by joining in the lacked shape. By this, the receptacle-side housing 60 can be produced easily and cheaply.

Figure 9A:
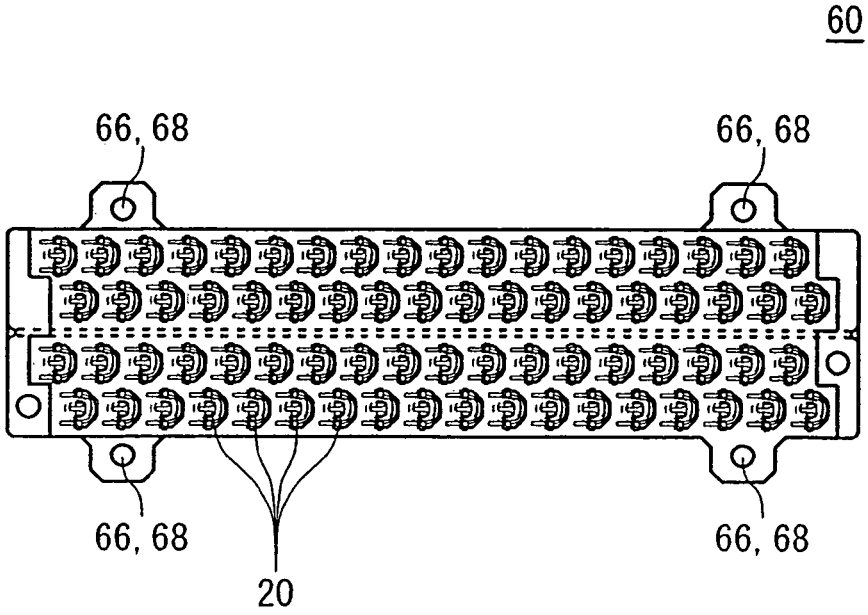
FIG. 9A shows a receptacle-side housing seen from a direction generally perpendicular to a surface of a receptacle-side board.
Figure 9B:
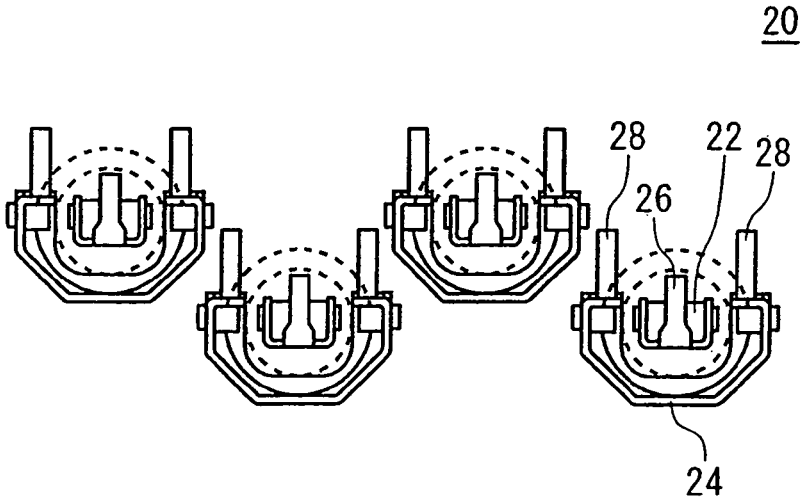
FIG. 9B shows the receptacle signal terminal in detail.

FIGS. 9A and 9B show examples of a detailed configuration of the receptacle-side housing 60. FIG. 9A shows the receptacle-side housing 60 seen from a direction generally perpendicular to a front face of the receptacle-side board 250 (see FIG. 6B). FIG. 9B shows the receptacle signal terminal 20 in detail.

The extension direction of each of the receptacle signal electrodes 26 directs to the predetermined arrangement orientation. According to this, the plurality of receptacle signal terminals 20 are disposed by this arrangement orientation. In the present embodiment, each of the plurality of receptacle signal terminals 20 is disposed respectively so that a half-moon direction directs to the arrangement orientation.

In this case, an open space formed in the half-room direction in the concerned receptacle signal terminal 20 of each of the receptacle signal terminals 20 is generally shielded by other semicircle part 23 neighboring each other in the half-room direction. By this, in the receptacle connector 300, influence of a noise such as cross talking from, for example, the neighboring receptacle signal terminals 20 may be reduced.

Figure 10A:
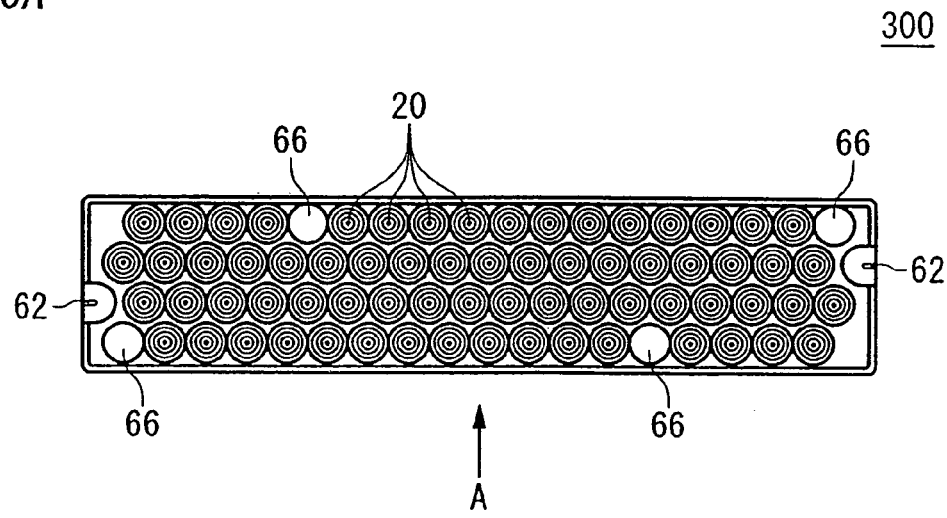
FIG. 10A shows the receptacle connector seen from a direction generally perpendicular to the connector contact surface
Figure 10B:
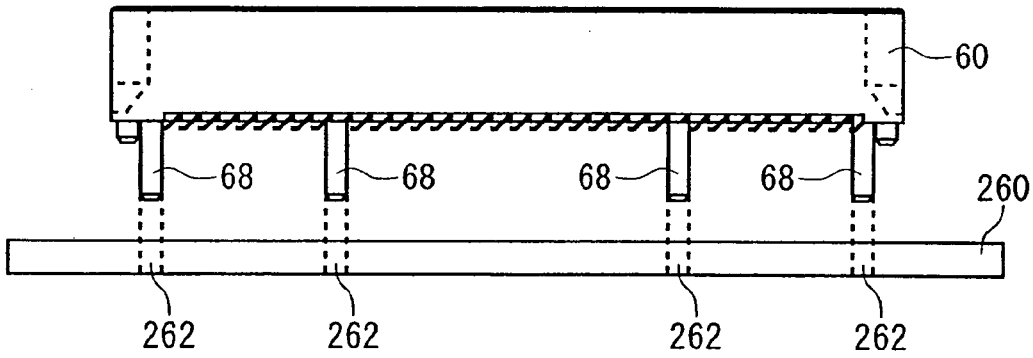
FIG. 10B shows the receptacle connector seen from the direction A.
Figure 10C:
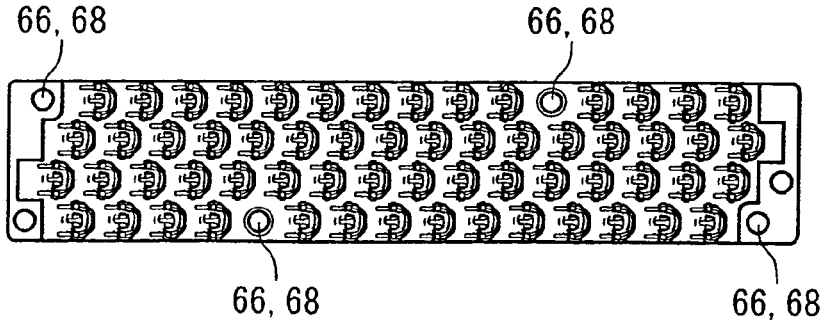
FIG. 10C shows the receptacle-side housing seen from a direction generally perpendicular to a surface of a receptacle-side board.

FIGS. 10A, 10B and 10C show the other examples of a configuration of the receptacle connector 300. FIG. 10A shows the receptacle connector 300 seen from a direction generally perpendicular to the connector contact surface. FIG. 10B shows the receptacle connector 300 seen from the direction A. FIG. 10C shows the receptacle-side housing 60 seen from a direction generally perpendicular to a front face of a receptacle-side board 260. In addition, because the constitutions having the same reference numbers as the reference numbers of FIG. 6 have the same or similar functions to the functions of the constitutions of FIG. 6, its explanation is omitted except for the following descriptions.

The four housing through-holes 66 to accommodate the rivets 68 are formed in the predetermined position of the plurality of accommodation parts 64 disposed by zigzag arrangement. In the present embodiment, the four housing through-holes 66 are formed in the position in which they may be engaged with the plug connector 100 of the state that turned 180 degrees in a direction facing to the connector contact surface.

The receptacle-side board 260 has board through-holes 262 formed by penetration from the front face opposed to the receptacle-side housing 60 to its rear face, in a position corresponding to the housing through-holes 66 in the receptacle-side housing 60. In the present embodiment, the receptacle-side housing 60 and the receptacle-side board 260 can be surely fixed by the rivets 68 inserted into the board through-holes.

Figure 11:
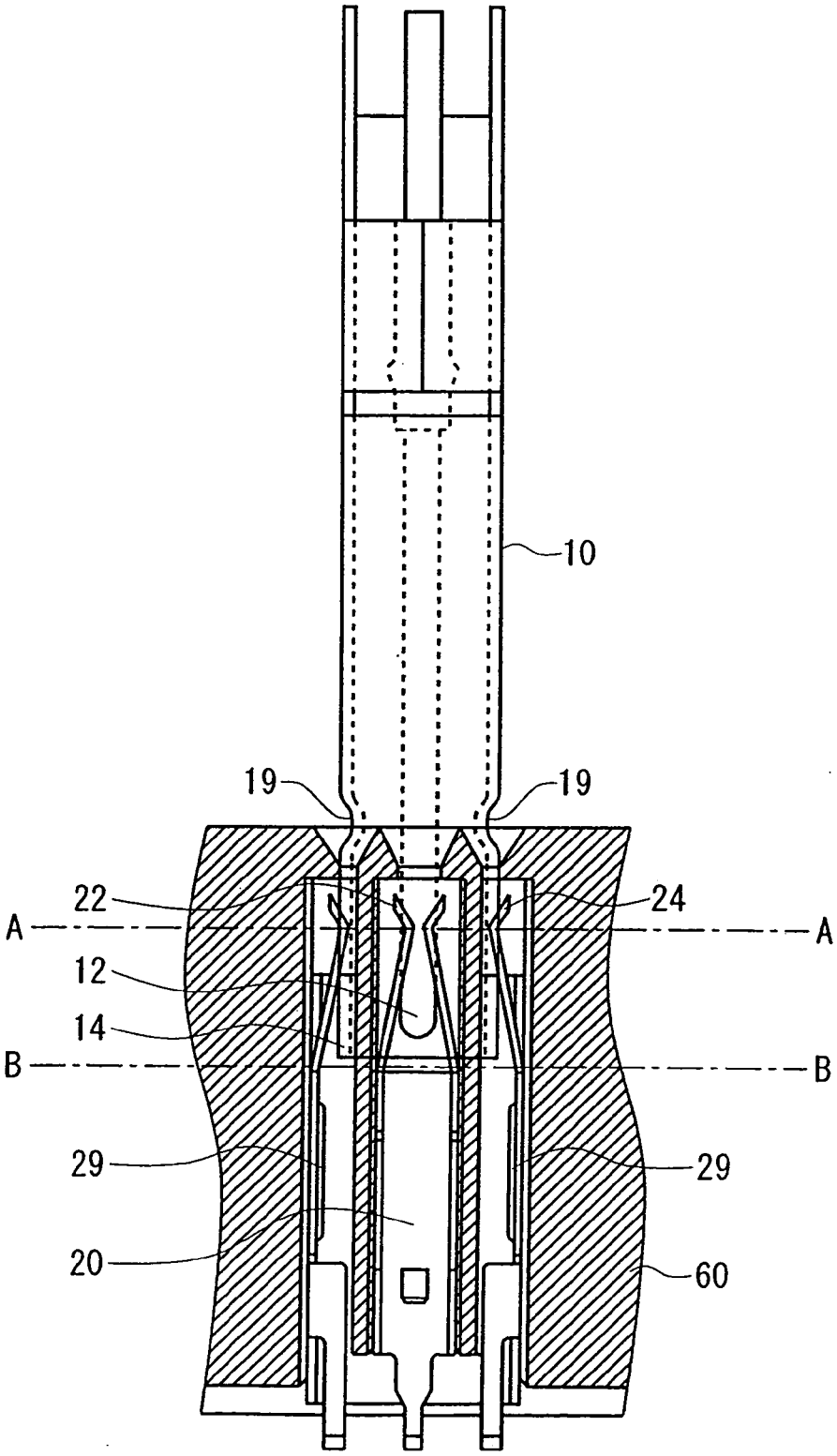
FIG. 11 is a sectional view showing the state that the plug signal terminal and the receptacle signal terminal are engaged.

FIG. 11 is a sectional view showing the state that the plug signal terminal 10 and the receptacle signal terminal 20 are engaged. In the present embodiment, the plug signal terminal 10 includes the plug signal core line 12 and the shield for plug core lines 14 that are terminals of a male type. In addition, the receptacle signal terminal 20 includes the receptacle signal core line 22 and the shield for receptacle core lines 24 that are terminals of a female type having a shape to engage with terminals of a male type.

When inserting the plug signal terminal 10 to the receptacle signal terminal 20, the receptacle signal core line 22 presses the outside by an elastic force in the inside contacted with the outside of the plug signal core line 12. The shield for receptacle core lines 24 presses the outside by an elastic force in the inside contacted with the outside of the shield for plug core line 14. By this, the receptacle signal core line 22 and the shield for receptacle core lines 24 are surely engaged with the plug signal core line 12 and the shield for plug core line 14.

Furthermore, in the present embodiment, when the plug signal terminal 10 are connected to the receptacle signal terminal 20, the shield for plug core line 14 is contacted with the shield for receptacle core lines 24 before the plug signal core line 12 is connected with the receptacle signal core line 22.

Then, until a tip of the shield for plug core line 14 is inserted into a predetermined position in inside of the shield for receptacle core lines 24, the shield for receptacle core lines 24 presses outside of the shield for plug core line 14 with an elastic force to increase gradually according to advance of the tip to inside of the shield for receptacle core lines 24. If the tip of the shield for plug core lines 14 is inserted into the predetermined position, the elastic force, with which the shield for receptacle core lines 24 presses outside of the shield for plug core line 14, has a generally constant value. After the tip of the shield for plug core lines 14 is inserted into the predetermined position, the plug signal core line 12 is connected to the receptacle signal core line 22.

By this, after the shield for receptacle core lines 24 has been expanded thoroughly, the plug signal core line 12 is surely inserted into the receptacle signal core line 22, and thus the force with which for example the plug signal terminal 10 is inserted into the receptacle signal terminal 20 may be reduced. Additionally, a crimp of the plug signal core line 12 can be prevented.

In addition, in the present embodiment, it is possible to protect electronic circuits by flowing the static electricity charged in the plug signal terminal 10 to ground or to protect DUT, in which an order of a power supply is predetermined, by contacting the receptacle signal core line 22 more rapidly than the plug signal core line 12.

As described above, the receptacle signal core line 22 and the shield for receptacle core lines 24 are respectively engaged with the plug signal core line 12 and the shield for plug core line 14. And, the plug signal terminal 10 is surely connected to the receptacle signal terminal 20 physically and electrically.

In addition, in the present embodiment, the shield for receptacle core lines 24 is formed so that the distance between the shield 24 and the shield for plug core line 14 is expanded bit by bit in the direction from the AA section to the BB section. By this, the shield for receptacle core lines 24 drives with an elastic force. In this driving space, the gap that is not filled by insulator such as resin of the receptacle-side housing 60 is generated between the shield for plug core lines 14 and the shield for receptacle core lines 24. Likewise, the gap that is not filled by, for example, resin is also generated between the plug signal core line 12 and the receptacle signal core line 22. According to this, an impedance value of a fitting face between the plug signal terminal 10 and the receptacle signal terminal 20 from the AA section to the BB section is higher than an impedance value of a fitting face in the place where other resin is filled.

However, in this example, a groove of the circle-shaped extension part 19 described by FIG. 2 compensates an impedance value so as to reduce the impedance value of the plug signal terminal 10 by shortening the distance between the plug signal core line 12 and the shield for plug core lines 14. Likewise, a groove of the semicircle-shaped extension part 29 described by FIG. 7 compensates an impedance value so as to reduce the impedance value of the receptacle signal terminal 20 by shortening the distance between the receptacle signal core line 22 and the shield for receptacle core lines 24. By this, in the present embodiment, deterioration of a signal occurred by mismatch of an impedance can be reduced.

In addition, in the present embodiment, the plug signal terminal 10 is a terminal of a male type, and the receptacle signal terminal 20 is a terminal of a female type. However, in other examples, the plug signal core line 12 and the shield for plug core lines 14 may be a male type, and the receptacle signal core line 22 and the shield for receptacle core lines 24 may be a female type, otherwise their types may be also determined.

Figure 12A:
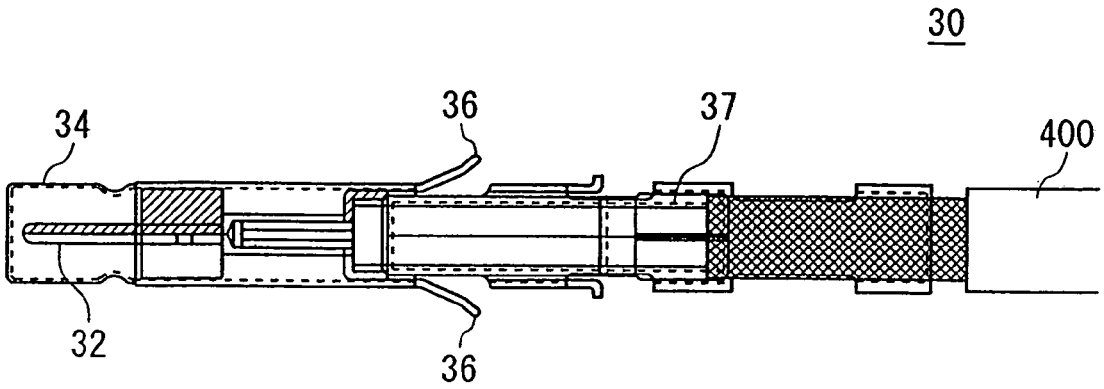
FIG. 12A shows an example of a detailed configuration of the plug signal terminal.
Figure 12B:
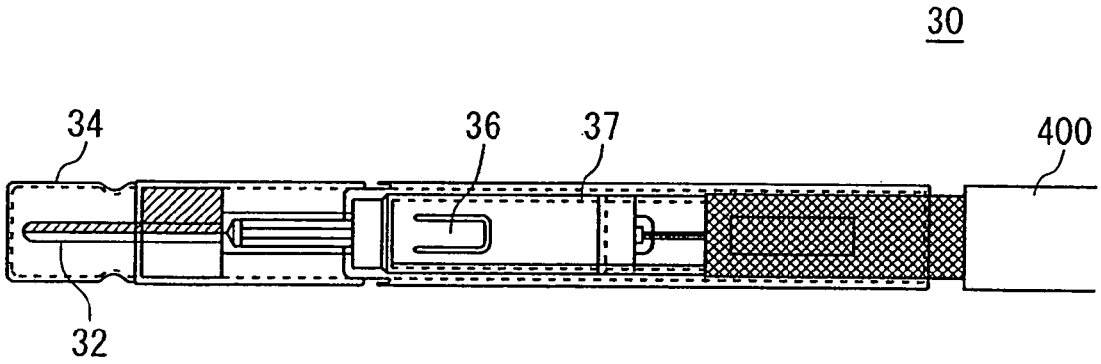
FIG. 12B shows an example of a detailed configuration of the plug signal terminal when it was turned 90 degrees as against an axis direction.

FIGS. 12A and 12B show the other examples of a configuration of a plug signal terminal 30. FIG. 12A shows an example of a detailed configuration of the plug signal terminal 30. FIG. 12B shows an example of a detailed configuration of the plug signal terminal 30 when it was turned 90 degrees as against an axis direction. In this example, the plug signal terminal 30 is a plus-side connector, and is held by a plug-side housing. The plug signal terminal 30 includes a plug signal core line 32, a first shield 34, a protrusion part 36, and a second shield 37.

The plug signal core line 32 is formed by the extension in the shape of a line with a conductor such as metal. In the plug signal core line 32, one end opposed to a coaxial cable 400 is electrically connected to a central conductor of the coaxial cable 400.

The first shield 34 is formed by a conductor insulated from the plug signal core line 32 electrically, so that the shield 34 encloses the core line 32 by the extension from the vicinity of the tip of the core line 32 to an axis direction of the core line 32. The first shield 34 is accommodated to a through-hole having the generally identical diameter as the diameter of the first shield 34. The through-hole is formed in the plug-side housing.

The protrusion part 36 protrudes in a direction separated from the plug signal core line 32, and is formed by the extension from the termination end of the first shield 34. By this, the plug signal terminal 30 is locked in the surface of the plug-side housing. In the present embodiment, the plug-side housing holds the plurality of plug signal terminals 30 by an arrangement corresponding to the plurality of receptacle signal terminals 20 described by, for example, FIG. 6 or FIG. 9.

The second shield 37 is formed from a conductor insulated from the plug signal core line 32 electrically, so that the shield 37 encloses the core line 32 by the extension from the tip to an axis direction. The tip of the second shield 37 is disposed opposite to the first shield 34, and intervenes between the plug signal core line 32 and the first shield 34 in the vicinity of the protrusion part 36. Another end of the second shield 37 is disposed opposite to the coaxial cable 400, and is electrically connected with outer conductor of the coaxial cable 400 and the second shield 37 by for example soldering.

The plug-side connector composed as above can adequately hold the plurality of plug signal terminals 30 by means of the plug-side housing. In addition, the plug-side connector can adequately relay an electric signal between the receptacle-side connector and the coaxial cable 400 that should be engaged.

As is apparent from the explanation, according to the present embodiment, a connector relaying a signal adequately can be offered.

Although the present invention has been described by way of exemplary embodiments, it should be understood that those skilled in the art might make many changes and substitutions without departing from the spirit and the scope of the present invention, which is defined only by the appended claims.

What is claimed is:

1. A connector mounted on a board, comprising:

a plurality of signal terminals; and a housing for holding said plurality of signal terminals by zigzag arrangement of a first row, a second row, a third row and a fourth row, all of them being parallel to each other, wherein said housing has at least two positioning holes to prescribe a position of other connectors to said connector, and wherein said positioning holes are disposed in said second and third rows, both being inner, by zigzag arrangements with said signal terminals, such that said positioning holes are adjacent to said signal terminals disposed on one end of each of said first and fourth rows, both being outer, and that said positioning holes are faced each other by intervention of said plurality of signal terminals.

2. The connector according to claim 1, wherein each of said signal terminals comprises:

a signal core line formed of conductor by extension in the shape of a line;

a shield for core line formed of conductor insulated from said signal core line electrically so as to extend in an axis direction of said signal core line;

a signal electrode formed by extension from said signal core line for connecting said signal core line with said board; and a ground electrode extended from said shield for core line for connecting said shield for core line with said board.

3. A connector mounted on a board, comprising:

a plurality of signal terminals; and a housing for holding said plurality of signal terminals by zigzag arrangement of a first row, a second row, a third row and a fourth row, all of them being parallel to each other, wherein said housing has through-holes for passing through rivets therein to fasten said housing to the board, and wherein said through-holes are disposed in said first and fourth rows, both being outer, by zigzag arrangements with said signal terminals.

4. The connector according to claim 3, wherein each of said signal terminals comprises:

a signal core line formed of conductor by extension in the shape of a line;

a shield for core line formed of conductor insulated from said signal core line electrically so as to extend in an axis direction of said signal core line;

a signal electrode formed by extension from said signal core line for connecting said signal core line with said board; and a ground electrode extended from said shield for core line for connecting said shield for core line with said board.

5. The connector claimed in claim 3, wherein two of said through-holes are disposed in said first row, and other two of said through-holes in said fourth row, wherein one of said two through-holes of said first row is disposed in one end of said first row, and one of said two through-holes of said fourth row are disposed in the other end of said fourth row, so as to face each other by intervention of said plurality of signal terminals, and wherein the other of said two through-holes of said first row and the other of said row through-holes of said fourth row are disposed in zigzag arrangements with said four through-holes.

6. The connector according to claim 5, wherein each of said signal terminals comprises:

a signal core line formed of conductor by extension in the shape of a line;

a shield for core line formed of conductor insulated from said signal core line electrically so as to extend in an axis direction of said signal core line;

a signal electrode formed by extension from said signal core line for connecting said signal core line with said board; and a ground electrode extended from said shield for core line for connecting said shield for core line with said board.

7. The connector claimed in claim 5, wherein said housing has at least two positioning holes to prescribe a position of other connectors to said connector, and wherein said positioning holes are disposed in said second and third rows, both being inner, by zigzag arrangements with said signal terminals, such that said positioning holes are adjacent to said signal terminals disposed on one end of each of said first and fourth rows, and that said positioning holes are faced each other by intervention of said plurality of signal terminals.

8. The connector according to claim 7, wherein each of said signal terminals comprises:

a signal core line formed of conductor by extension in the shape of a line;

a shield for core line formed of conductor insulated from said signal core line electrically so as to extend in an axis direction of said signal core line;

a signal electrode formed by extension from said signal core line for connecting said signal core line with said board; and a ground electrode extended from said shield for core line for connecting said shield for core line with said board.

9. A connector mounted on a board, comprising:

a plurality of signal terminals; and a housing for holding said plurality of signal terminals by zigzag arrangement of a first row, a second row, a third row and a fourth row, all of them being parallel to each other, wherein each of said signal terminals includes:

a signal core line formed of conductor by extension in the shape of a line;

a shield for core line formed of conductor insulated from said signal core line electrically so as to extend in an axis direction of said signal core line;

a signal electrode formed by extension from said signal core line for connecting said signal core line with said board; and a ground electrode extended from said shield for core line for connecting said shield for core line with said board.

10. The connector claimed in claim 9, wherein said ground electrode includes a plurality of grand electrodes extended from said shield for core line and opposed to each other by intervention of said signal electrode for connecting said shield for core line with said board.

11. A connector mounted on a board having a plurality of board signal lines for transmitting a signal and a board ground line grounded, including:

a plurality of signal terminals; and a housing for holding said plurality of signal terminals by zigzag arrangement of a first row, a second row, a third row and a fourth row, all of them being parallel to each other, wherein said housing has at least two positioning holes to prescribe a position of other connectors to said connector, and wherein said positioning holes are disposed in said second and third rows, both being inner, by zigzag arrangements with said signal terminals, such that said positioning holes are adjacent to said signal terminals disposed on one end of each of said first and fourth rows, both being outer, and that said positioning holes are faced each other by intervention of said plurality of signal terminals, wherein said signal terminals includes:

a signal core line formed of conductor by extension in the shape of a line;

a first shield formed of conductor insulated from the signal core line electrically and accommodated in the housing so that the first shield encloses the signal core line by the extension from the vicinity of the tip of the signal core line to an axis direction of the signal core line;

a protrusion part protruded in a direction depart from the signal core line and formed by the extension from the termination end of the first shield to be locked in the surface of the housing; and a second shield formed of conductor insulated from the signal core line electrically so that the tip intervenes between the signal core line and the first shield in the vicinity of the protrusion part and the second shield encloses the signal core line by the extension from the tip to an axis direction.

12. The connector according to claim 11, wherein said signal core line is electrically connected to a central conductor of a conical cable, and said second shield is electrically connected to an outer conductor of the conical cable.

* * * * *